US005920041A

United States Patent [19]

Furuta et al.

[11] Patent Number: 5,920,041

[45] Date of Patent: Jul. 6, 1999

[54] STRUCTURE FOR MOUNTING SOUND ABSORBING MEMBER ON TOP PORTION OF SOUND INSULATION WALL AND METHOD OF MOUNTING THE SAME

[75] Inventors: Naoyuki Furuta, Tokyo; Shinta Yamamura, Kanagawa; Tadanori Mizukami, Tokyo; Yutaka Tasaki, Kanagawa; Takashi Mikami, Tokyo, all of Japan

[73] Assignee: Nitto Boseki Co., Fukushima, Japan

[21] Appl. No.: 09/027,567

[22] Filed: Feb. 23, 1998

[30] Foreign Application Priority Data

Feb. 26, 1997 [JP] Japan ..... 9-058429

[51] Int. Cl.[6] ..... G10K 11/00

[52] U.S. Cl. ..... 181/210

[58] Field of Search ..... 181/210, 284, 181/285, 286, 290, 294, 295, 293; 52/144, 145

[56] References Cited

U.S. PATENT DOCUMENTS 4,436,179 3/1984 Yamamoto et al. ..... 181/210
4,899,846 2/1990 Furuta et al. ..... 181/210
5,329,073 7/1994 Shono et al. ..... 181/210
5,521,338 5/1996 Shono et al. ..... 181/210
5,741,369 4/1998 Yamamura et al. ..... 181/210

FOREIGN PATENT DOCUMENTS 6-235209 8/1994 Japan .

*Primary Examiner*—Khanh Dang

*Attorney, Agent, or Firm*—Sixbey, Friedman, Leedom & Ferguson; David S. Safran

[57] ABSTRACT

An outer mounting rail at a side opposite to a sound source side and an inner mounting rail at the sound source side are fixed to a metal securing part secured to an attachment base portion projecting from a top portion of a sound insulation wall. An outer stationary rail fixed to a sound absorbing body is fixed to the outer mounting rail by a joint bar, and an inner stationary rail fixed to the sound absorbing body is fixed to the inner mounting rail.

10 Claims, 11 Drawing Sheets

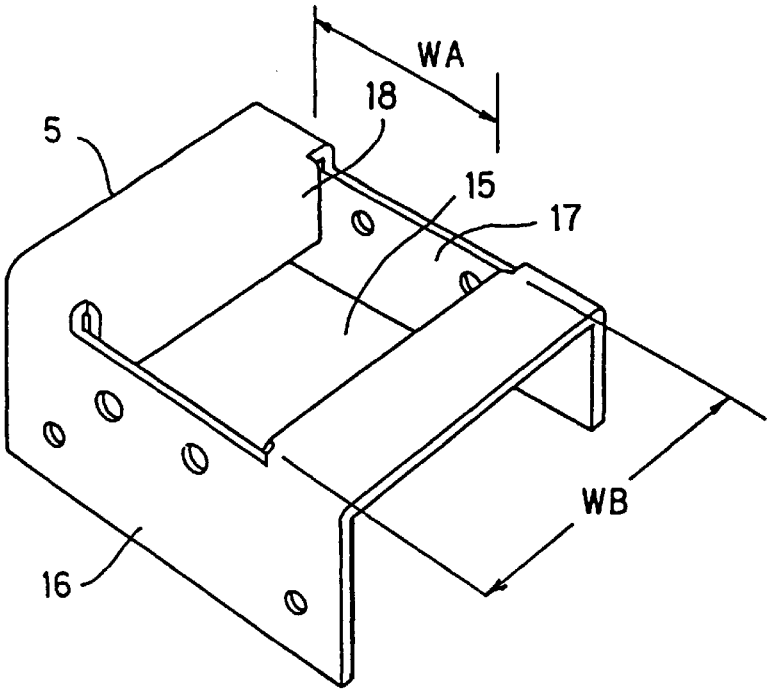
FIG. 2
FIG. 3
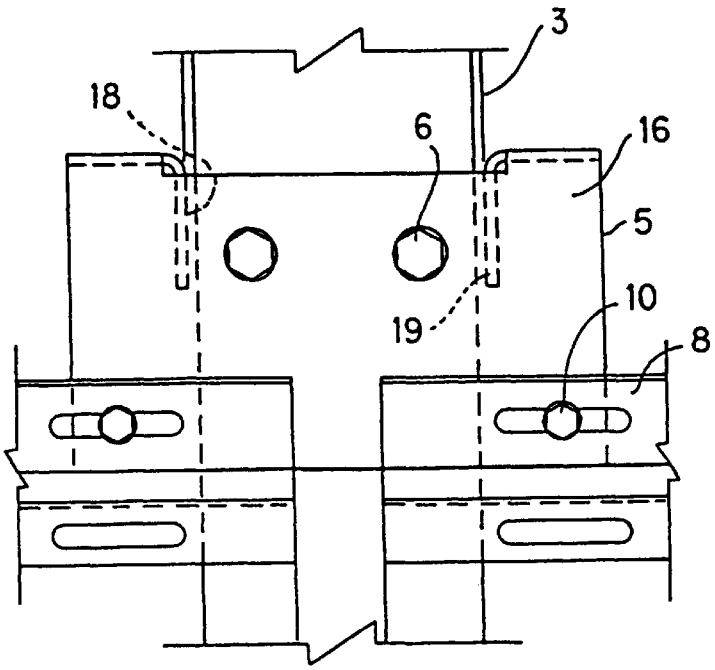

STRUCTURE FOR MOUNTING SOUND ABSORBING MEMBER ON TOP PORTION OF SOUND INSULATION WALL AND METHOD OF MOUNTING THE SAME

BACKGROUND OF THE INVENTION

The present invention relates to improvements in a structure for mounting a sound absorbing member on the top portion of a sound insulation wall for preventing noise and the like caused by running vehicles on an expressway or the like and a method of mounting the sound absorbing member.

As sound absorbing apparatuses which are capable of preventing noise caused from an expressway, a railway, a plant or the like and absorbing and eliminating diffracted noise and which is mounted on the top end of a sound insulation wall, a structure disclosed in Japanese Patent Unexamined Publication No. Hei. 6-235209 has been known. A structure for mounting the sound absorbing member which is the main component of the sound absorbing unit of the foregoing type requires various operations including operations for screwing bolts and nuts which are performed on the inner and outer portions of the sound insulation wall.

Therefore, when the operations are performed for an elevated expressway, the operations on the road side, that is, on positions at a sound source side are required. Moreover, mounting operations which are performed in the portion opposite to the road, that is, on the outside of the sound insulation wall opposite to the sound source side must be performed. Therefore, a scaffolding or the like must be built on the outside of the sound insulation wall, or a heavy machine, such as an overhang car, must be used. The safety of the operations cannot always be secured. Moreover, various elements including the sound absorbing members must be prepared to be adaptable to the specified dimensions of the elements for the sound insulation wall. As a result, a large number of elements and working processes are required, thus causing a problem to arise in that an excessively long time and great labor are required for repair and maintenance.

SUMMARY OF THE INVENTION

To solve the problems experienced with the conventional structure and method of mounting the sound absorbing members, an object of the present invention is to provide a mounting structure and method with which an operation for mounting a sound absorbing member on the top portion of a sound insulation wall can be completed by only securing operations including operations for mounting the elements and screwing bolts and nuts, performed at the side of the road portion of the sound insulation wall, that is, at the sound source side. Moreover, adaptation to a variety of sound insulation walls having different specified dimensions is permitted by combining sole-type elements, an ordered attitude and sufficiently strong rigidity can be obtained, repair and maintenance can easily be performed, safety of the operations is high, and the number of elements and labor can be reduced.

To solve the problems, the mounting structure and method according to the present invention are arranged in such a manner that sound absorbing members are prepared, each of which has a structure that an outer stationary rail having a substantially arch-shaped cross section is secured to a portion of an inner wall of an inner cavity opened downwards and formed in the sound absorbing member opposite to a sound source side, in such a manner that a bent stepped central portion of the substantially arch-shaped rail is secured to the inner wall, and an inner stationary rail having a lower end portion, the cross section of which is formed into an inverted and reversed L-shape, is secured to an inner surface of the inner cavity placed at the sound source side in such a manner that an L-shape projecting and stepped portion of the inner stationary rail faces the sound source side.

Then, a portion of a sound insulation wall at the sound source side is made to be a working position. Then, a metal securing member for securing the sound absorbing member is secured to each of attachment base portions which project over the top portions of a sound insulation wall.

Then, an outer mounting rail having an upper end portion, the cross section of which is formed into an inverted L-shape and a lower end portion, the cross section of which is formed into an inverted and reversed F-shape, is secured to a side surface of the metal securing member opposite to the sound source side in such a manner that an inverted-F-shape opening portion thereof faces outside and the outer mounting rail is secured between adjacent metal securing members. Then, an inner mounting rail having a lower end portion, the cross section of which is formed into an inverted and reversed L-shape, is secured between adjacent metal securing members on the surfaces of the metal securing members at the sound source side in such a manner that a projecting and stepped portion having an inverted L-shape cross section faces the sound source side.

Then, the sound absorbing member is, from an upper position, mounted on a portion between adjacent attachment base portions, to which the two mounting rails have been secured, in such a manner that the sound absorbing member is attracted to a portion opposite to the sound source side while is inserted in both the mounting rails so that the sound absorbing member is arranged at a specified position, the sound absorbing member is attracted toward the sound source side, a lower bent stepped portion of a substantially arch-shaped cross section of the outer stationary rail is received in a groove formed in the lower end portion of the inverted and reversed F-shape cross section of the outer mounting rail, the vertical wall portions of the two rails are brought into contact with each other, a flange portion of the top portion of the outer stationary rail and a flange portion of the upper portion of the inverted L-shape cross section of the outer mounting rail are disposed on the same plane, vertical walls following the respective flange portions are brought into contact with each other, and a single joint bar of a sectional shape having substantially arched lips is, from a lengthwise direction, mounted on the two flange portions disposed on the same plane so that the two flange portions are held and secured.

Then, the inner surface of a lower end portion of the inner stationary rail having the inverted and reversed L-shape cross section is brought into contact with the outer surface of the lower end portion of the inner mounting rail having the inverted and reversed L-shape cross section so as to secure the two rails, and the above-mentioned process is repeated. As described above, the structure and method of mounting the sound absorbing members on the top portion of the sound insulation wall according to the present invention are achieved.

BRIEF DESCRIPTION OF THE DRAWINGS

FIG. 2 is a perspective view showing an example of a metal securing member.

FIG. 3 is a front view showing a portion including the metal securing member shown in FIG. 1.

DETAILED DESCRIPTION OF THE INVENTION

Figure 1:
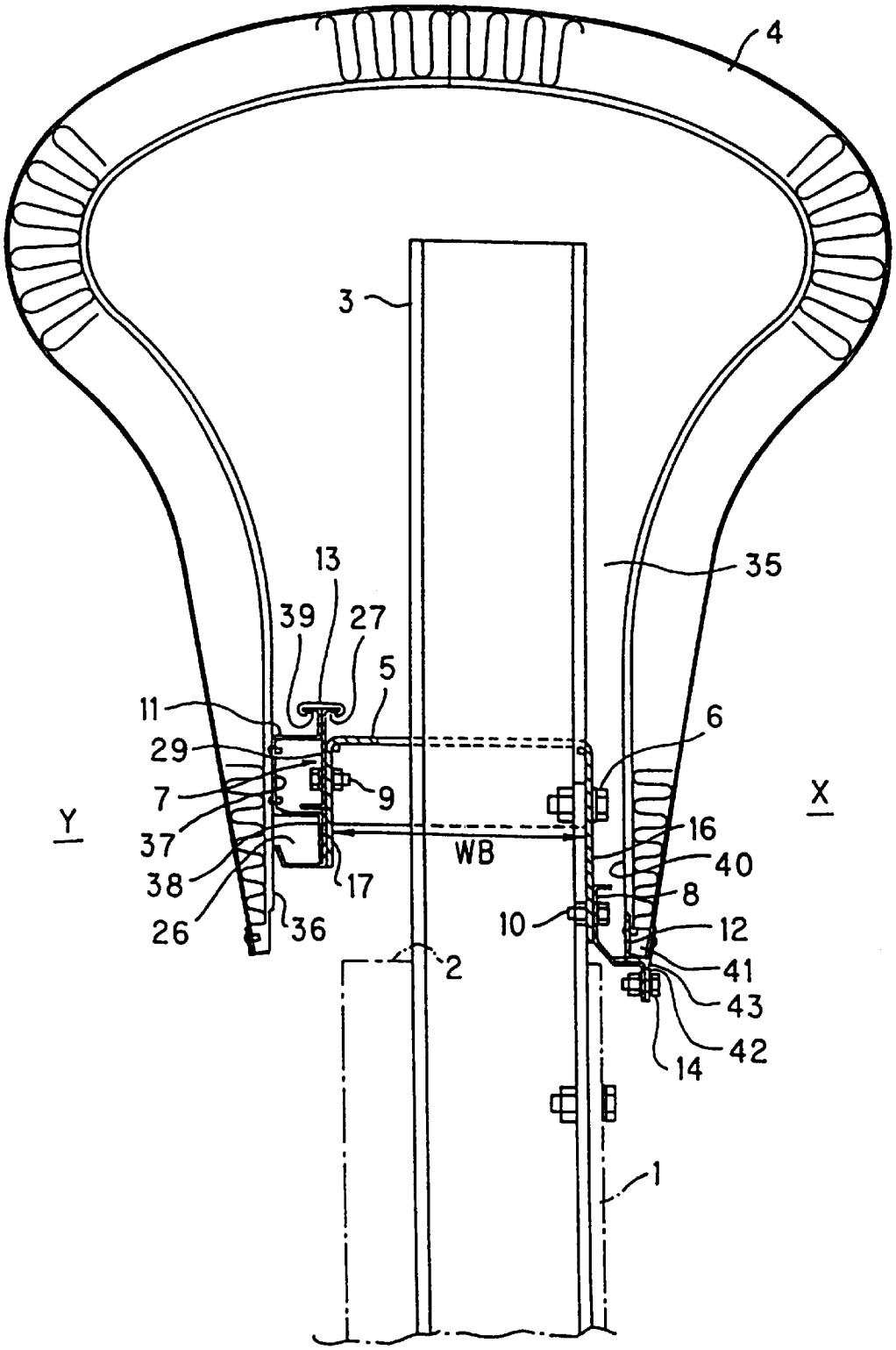
FIG. 1 is a schematic cross sectional view showing an embodiment of the present invention.

FIGS. 1 to 17 show an embodiment of the present invention. FIG. 1 shows a mounting structure in which a metal member 5 for securing a sound absorbing member 4 is fitted to each of attachment base portions 3 which are disposed at the same intervals and arranged to project upwards over a top portion 2 of a sound insulation wall 1. The metal securing member 5 is secured by a bolt and nut 6. An outer mounting rail 7 and an inner mounting rail 8 are secured to the metal securing member 5 with bolts and nuts 9 and 10. An outer stationary rail 11 and an inner stationary rail 12 previously secured to the sound absorbing member 4 are secured to the outer mounting rail 7 and the inner mounting rail 8 with a joint bar 13 and a bolt and nut 14. Thus, the sound absorbing member 4 is secured to the top portion 2 of the sound insulation wall 1.

The attachment base portion 3 shown in FIG. 1 is formed by removing an uppermost sound insulation wall from H-steel serving as a support column for securing and supporting the sound insulation wall 1. If a sound insulation wall column is newly formed, the attachment base portion 3 may be formed by previously projecting the upper portion of the H-Steel by a short length. In a sound insulation wall column which has been constructed, an attachment base portion 3 which has an arbitrary structure may be secured to the top portion 2 of the sound insulation wall 1 by welding, with bolts or the like.

As shown in FIGS. 1 to 3, the metal securing member 5 has an insertion hole 15 through which the attachment base portion 3 made of the H-steel can be inserted. Moreover, securing walls 16 and 17 are formed downwards at a sound source side X and a side Y opposite to the sound source side. On the two sides of the insertion hole 15, guide walls 18 and 19 to correspond to the attachment base portion 3 are formed downwards. Note that the structure of the metal securing member 5 is not limited to the above-mentioned structure. As a matter of course, any structure may be employed if the employed shape is able to fit the outer shape of the attachment base portion.

Figure 4:
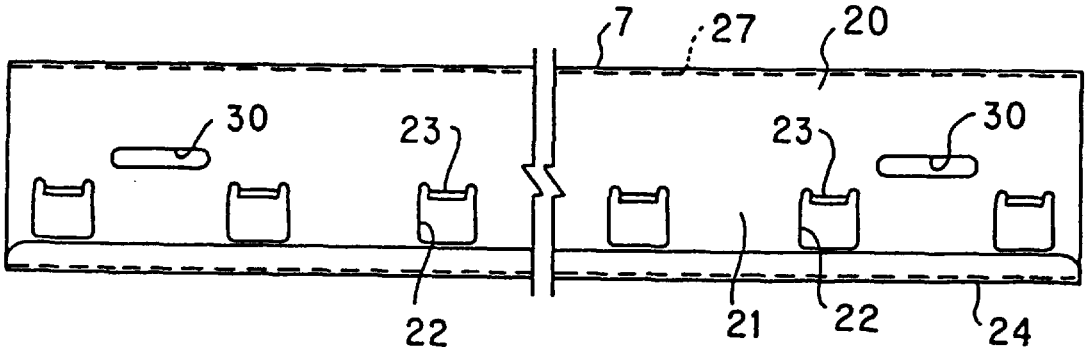
FIG. 4 is a front view showing the outer mounting rail shown in FIG. 1.
Figure 5:
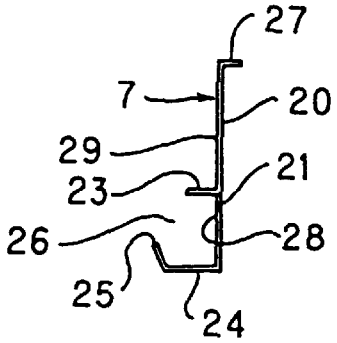
FIG. 5 is a right-hand view of the structure shown in FIG. 4.

The outer mounting rail 7 of the embodiment shown in FIG. 1 is composed of an upper end portion 20 having an inverted L-shape cross section and a lower end portion 21 having an inverted and reversed F-shape, as shown in FIGS. 4 and 5. In an example shown in FIGS. 4 and 5, a punched hole 22 is formed in the lower end portion 21. Moreover, a tag 23 projecting in a direction Y opposite to the sound source side is formed on the upper end portion of the punched hole 22. The tag 23 and a bottom end 24 of the lower end portion 21 form a groove 26 having an opening 25 formed into a reversed F-shape as shown in FIG. 5. The upper end of the upper end portion 20 has a flange portion 27 having an inverted L-shape and extending in the direction X toward the sound source side.

The outer mounting rail 7 according to this embodiment has a structure that a portion between the tag 23 and the bottom end 24 and a portion between the tag 23 and the flange portion 27 are formed into vertical walls 28 and 29, respectively. If the groove 26, the vertical wall 29 and the flange portion 27 can be formed, the structure is not limited to the illustrated structure. Note that an elongated hole 30 shown in FIG. 4 is a mounting hole which are adapted to the bolt and nut 9.

Figure 6:
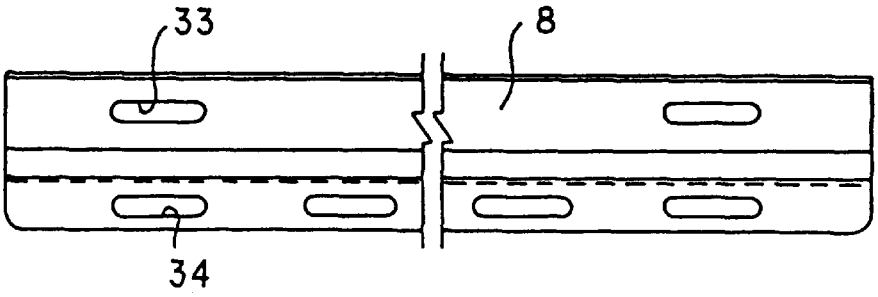
FIG. 6 is a front view showing the inner mounting rail shown in FIG. 1.
Figure 7:
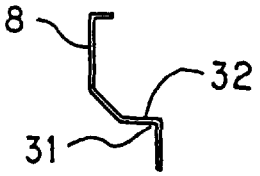
FIG. 7 is a left-hand view of the structure shown in FIG. 6.

As shown in FIGS. 6 and 7, the inner mounting rail 8 shown in FIG. 1 has a lower end 31 having an inverted and reversed L-shape cross section. A projecting step 32 of the lower end 31 is allowed to project toward the sound source side X. An elongated hole 33 shown in FIG. 6 is a mounting hole adapted to the bolt and nut 10, while an elongated hole 34 is a mounting hole adapted to the bolt and nut 14.

The operation for mounting the metal securing member 5, the outer mounting rail 7 and the inner mounting rail 8 is performed by using the bolts and nuts 6, 9 and 10. In a case where the operation is performed on the source side X of the sound insulation wall 1, that is, on the side of an elevated expressway, a working platform or a platform car positioned on the road side is used and the operation is performed in accordance with a procedure shown in FIGS. 8 and 9.

Figure 9:
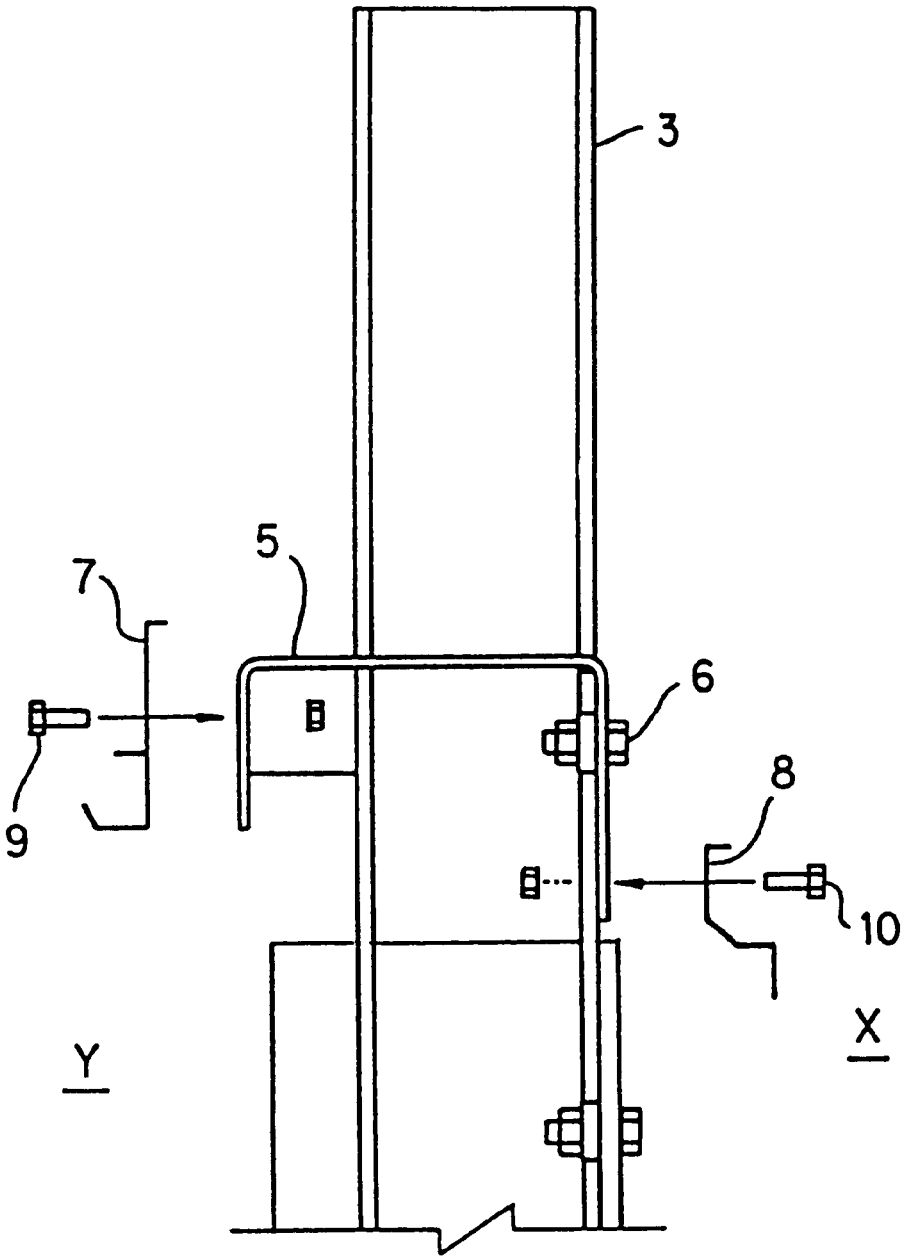
FIG. 9 is an explanatory view of the operation for mounting the inner and outer mounting rails shown in FIG. 1.

That is, the metal securing member 5 is, from an upper position, mounted on the attachment base portion 3. Then, a bolt 6B is screwed to a nut 6A previously located and welded to the attachment base portion 3. As an alternative to this, a bolt hole previously located and formed and a bolt and nut are screwed. Thus, a state as shown in FIG. 9 in which the metal securing member 5 is secured, is realized. Moreover, the outer mounting rail 7 is joined to the metal securing member by using the mounting hole 30 with the bolt and nut 9 from the side Y opposite to the sound source side. Then, the inner mounting rail 8 is joined from the sound source side X by using the elongated hole 33 with the bolt and nut 10.

Figure 10:
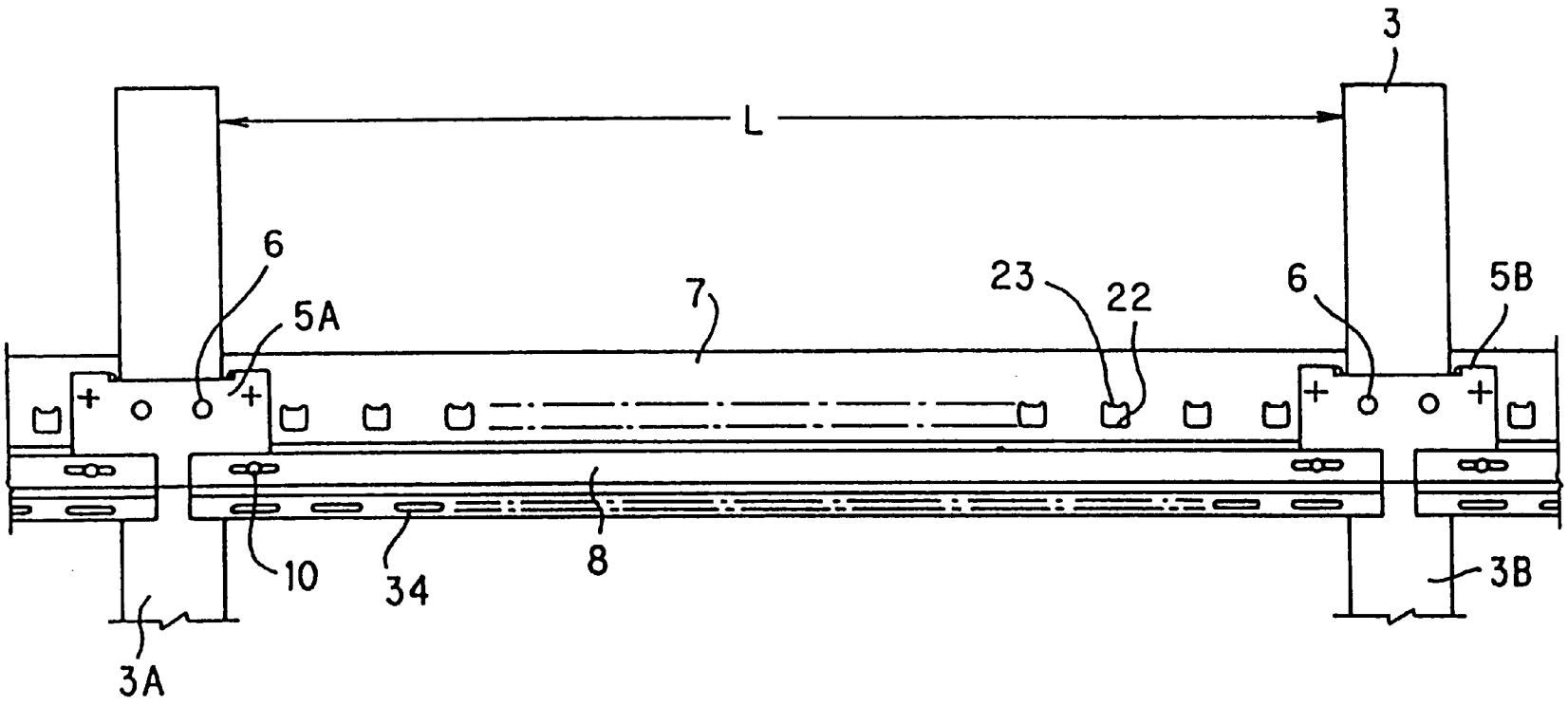
FIG. 10 is a front view showing the structure for mounting the base portion for mounting, the metal securing member, the outer mounting rail and the inner mounting rail shown in FIG. 1.

As shown in FIG. 10, the outer mounting rail 7 and the inner mounting rail 8 are secured between metal securing members 5A and 5B secured to adjacent attachment base portions 3A and 3B which are formed apart from each other for distance L.

The outer stationary rail 11 is previously secured to an inner wall 36 of an inner space 35 opened in the lower surface of the sound absorbing member 4, the inner wall 36 being opposite to the outer mounting rail 7. The illustrated outer stationary rail 11 has an arch-shaped cross section having a central bent stepped portion 37 which is secured to the inner wall 36. A bent stepped portion 38 is formed in the lower portion of the outer stationary rail 11, while a flange portion 39 is formed at the top end of the outer stationary rail 11 to extend opposite to the sound source side.

In the present invention, the cross sectional shape of the outer stationary rail 11 is expressed as an arched shape. As long as a structure corresponding to the bent stepped portion 37 required to be secured to the inner wall 36, a structure corresponding to the bent stepped portion 38, and a structure corresponding to the flange portion 39 are formed, a shape in the form of lowercase epsilon or inverted lowercase omega may be employed. The "arched shape" includes the above-mentioned shapes.

The inner stationary rail 12 having a lower end 42 with an inverted reversed L-shape is secured to an end 41 of the opened portion of an inner wall 40 opposite to the inner mounting rail 8 of the inner space 35. The inner stationary rail 12 is secured in such a manner that a projecting step 43 formed into an inverted L-shape faces the sound source side X.

The sound absorbing member 4 has a mushroom-like shape in the drawing. Since the sound absorbing member 4 absorbs noise, and absorbs and eliminates diffracted noise at the top portion of the sound insulation wall, the cross sectional shape and material of the sound absorbing member 4 are not specified.

Figure 11:
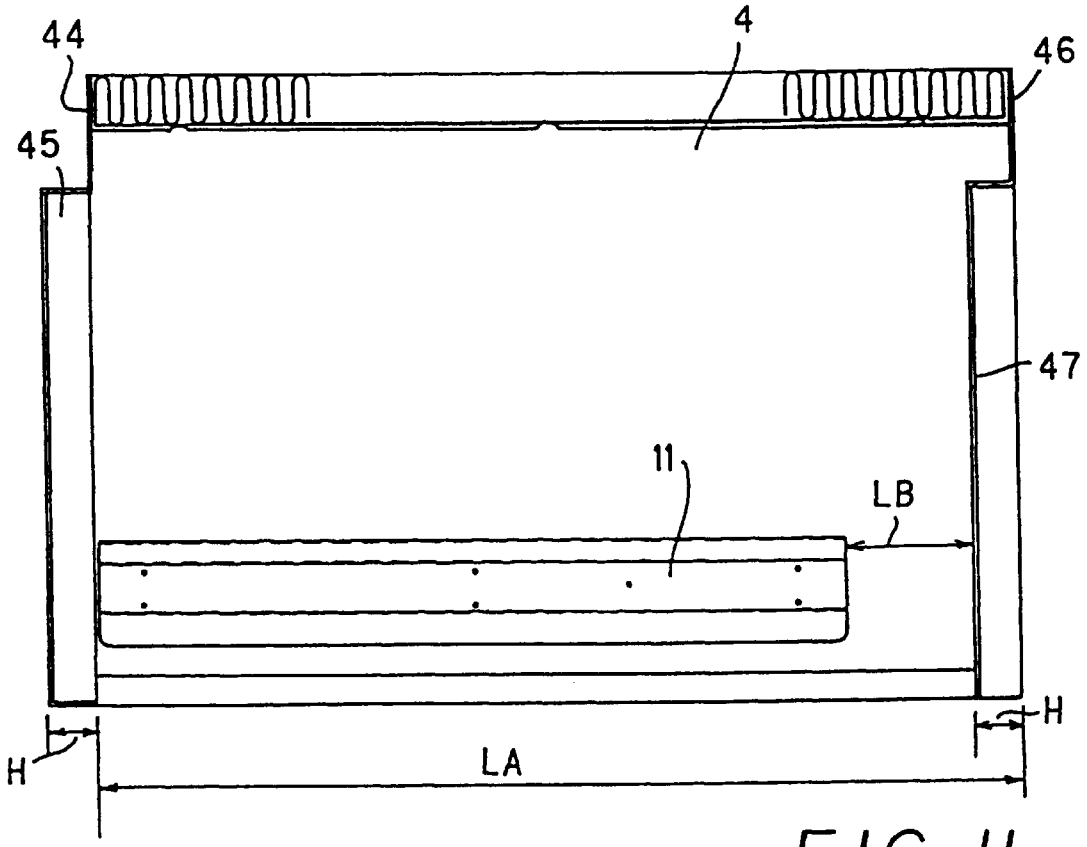
FIG. 11 is a vertical cross sectional view taken along an axial line of the sound absorbing member shown in FIG. 1.
Figure 12:
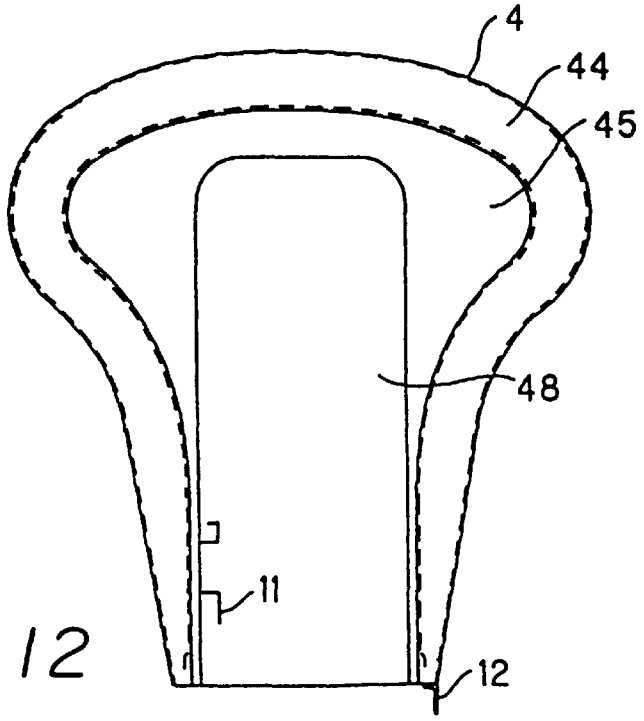
FIG. 12 is a left-hand side view prior to cutting the sound absorbing member shown in FIG. 11.

As shown in FIGS. 11 and 12, the sound absorbing member 4 has a left-hand end surface which is closed by closing plates 44 and 45, and a right-hand end surface which is closed by closing plates 46 and 47. The closing plate 45 is allowed to project in a direction of the length of the sound absorbing member 4 by length H. On the other hand, the closing plate 47 is recessed in the direction of the length by the length H. As described later, the projecting closing plate 45 of the following sound absorbing member 4 is received by the recessed closing plate 47 of the forward sound absorbing member 4 when the sound absorbing members 4 are disposed adjacently. Thus, any gap is not formed between adjacent sound absorbing members.

When the attachment base portion 3 is formed by the H-steel column, an opened portion 48 through which the attachment base portion 3 is able to pass, is formed in the central portion of the closing plate 45. Note that the sound absorbing member 4 is previously manufactured in a manufacturing plant, and then transported to the site of the construction.

Figure 8:
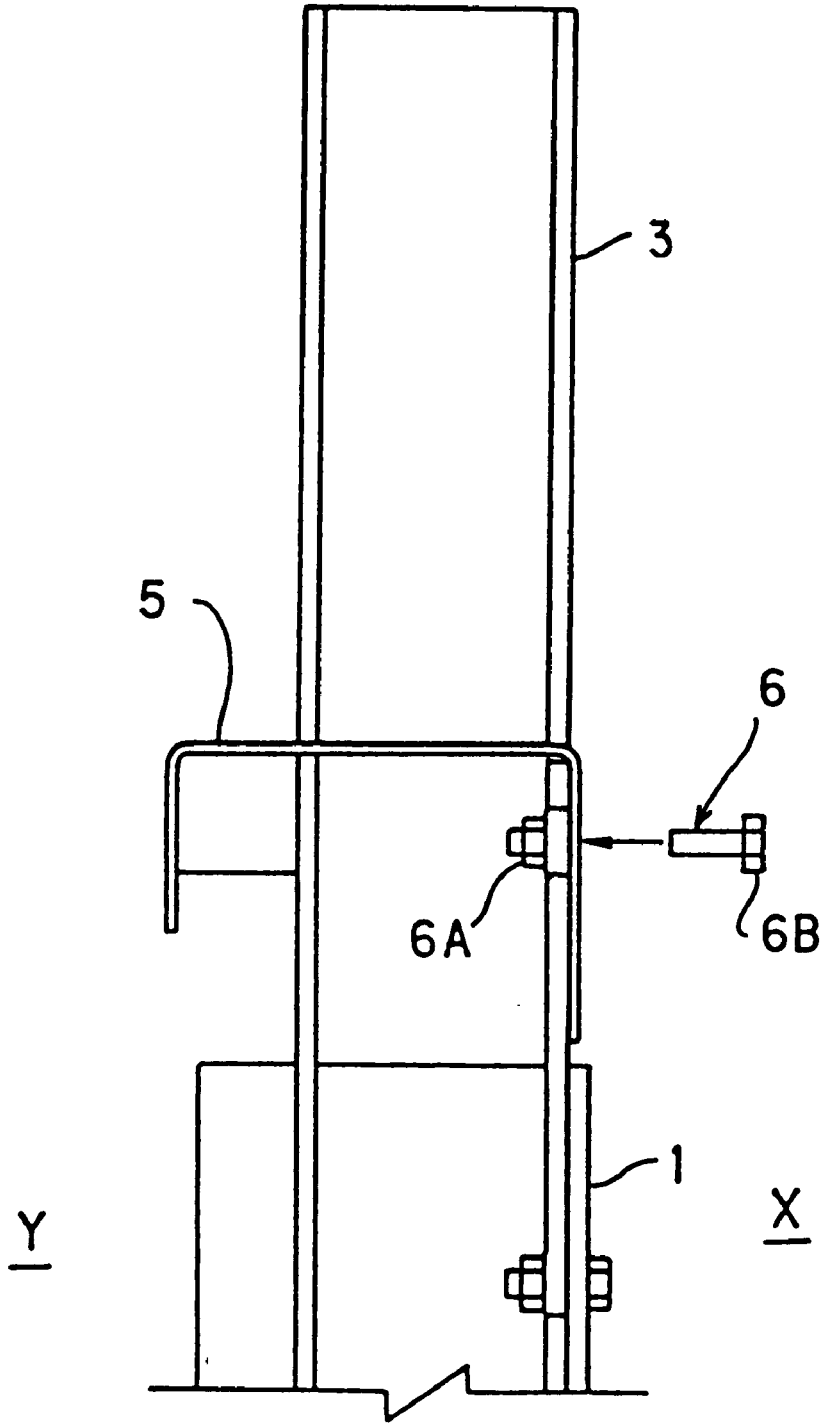
FIG. 8 is an explanatory view of the operation for mounting the metal securing member shown in FIG. 1.
Figure 13:
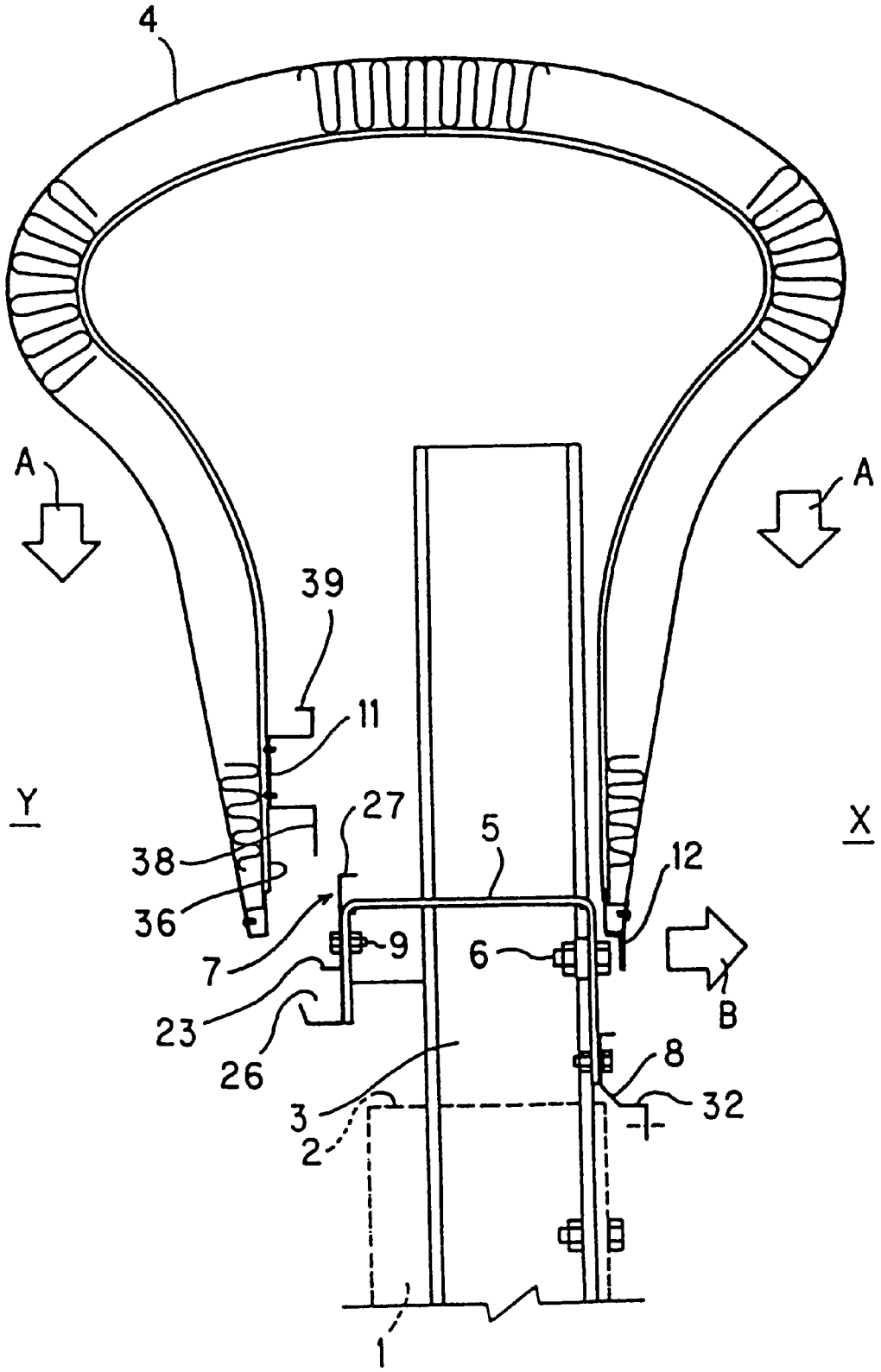
FIG. 13 is an explanatory view showing the operation for mounting the sound absorbing member on the top portion of the sound insulation wall.
Figure 14:
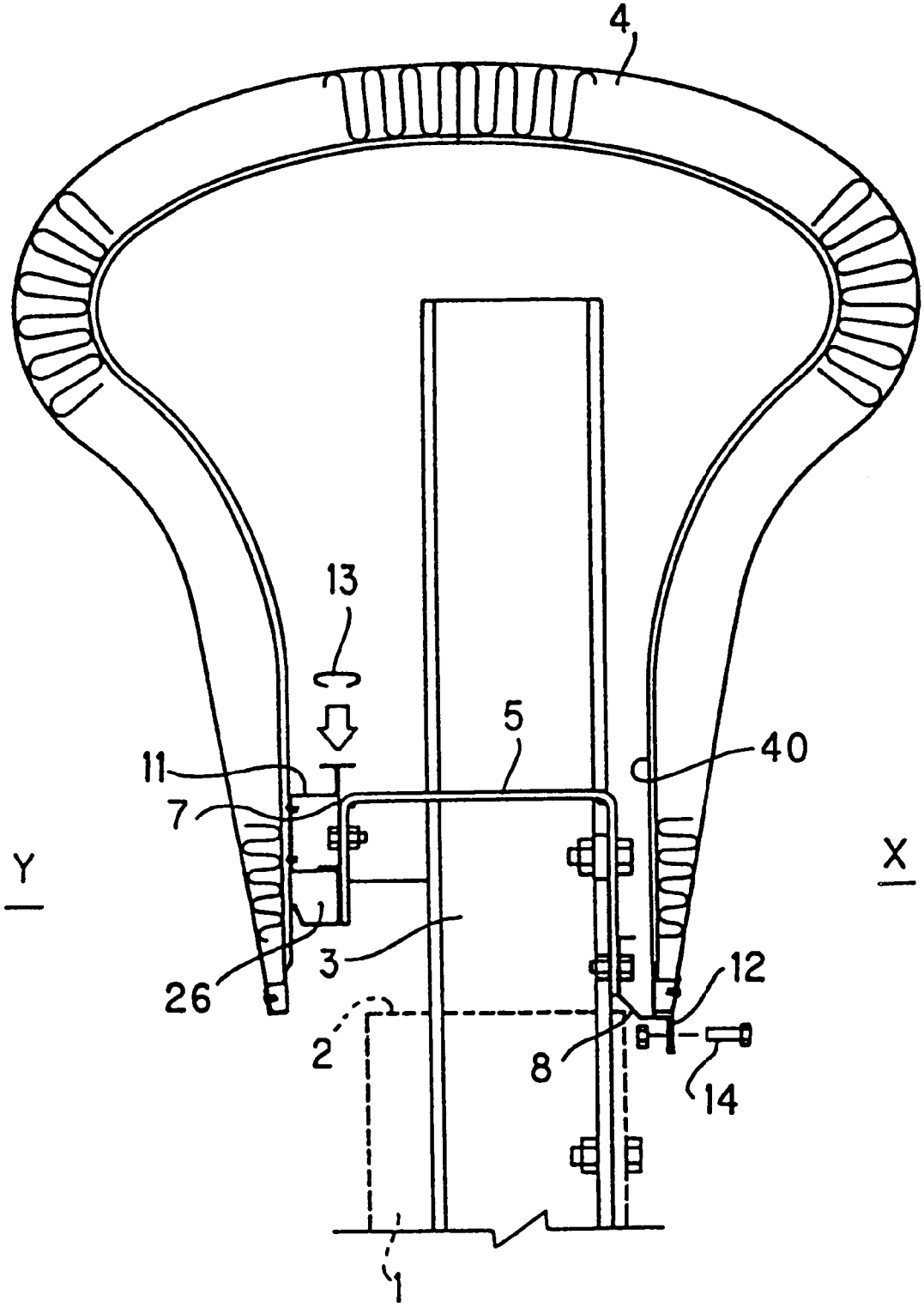
FIG. 14 is an explanatory view showing an operation for joining the sound absorbing member and the inner and outer mounting rails.

The sound absorbing member 4 shown in FIGS. 11 and 12 is mounted on the top portion of the sound insulation wall 1 assembled as shown in FIGS. 8 and 9 by a procedure shown in FIGS. 13 and 14. That is, a working platform or a platform car positioned in the road portion adjacent to the sound source side X of the sound insulation wall 1, that is, on the road of an elevated expressway, is used. Then, the sound absorbing member 4 to which the outer stationary rail 11 and the inner stationary rail 12 are secured is, from an upper position, mounted between the adjacent attachment base portions 3 to which the outer mounting rail 7 and the inner mounting rail 8 have been secured by the metal securing member 5. That is, as shown in FIG. 10, the sound absorbing member 4 is mounted between the attachment base portions 3A and 3B, as indicated by an arrow A shown in FIG. 13. Then, the bent stepped portion 38 of the outer stationary rail 11 is inserted into the groove 26 of the outer mounting rail 7. Thus, the vertical positions of the rails are fixed, and then the sound absorbing member 4 is attracted toward the sound source side X, as indicated by an arrow B shown in FIG. 13. The bent stepped portion 38 and the groove 26 are brought into contact with each other, while the vertical wall 29 of the outer mounting rail 7 and a vertical wall portion just below the flange portion 39 of the outer stationary rail 11 are brought into contact with each other. Thus, the position of the sound absorbing member 4 with respect to the sound source is fixed.

The dimensions and shapes of the outer stationary rail 11 and the outer mounting rail 7 are previously determined in such a manner that the flange portion 39 and the flange portion 27 form one plane, and the vertical wall portions are brought into contact with each other, when the outer stationary rail 11 and the outer mounting rail 7 have been positioned as described above.

A single joint bar 13 of a sectional shape having substantially arched lips is fitted to the flange portions 39 and 27 disposed to form one plane. Thus, the two flange portions 39 and 27 are held and secured.

When the sound absorbing member 4 is moved diagonally in the directions indicated by the arrows A and B, the inner surface of the projecting step 43 of the inner stationary rail 12 is brought into contact with the outer surface of the projecting step 32 of the inner mounting rail 8. Therefore, the two rails 12 and 8 are screwed to each other with the bolt and nut 14 through the elongated hole 34. Thus, the process for mounting the sound absorbing member 4 shown in FIG. 13 is completed.

The outer stationary rail 11 of the sound absorbing member 4 has a length which is shorter than length LA of one sound absorbing member 4 by length LB, as shown in FIG. 11. Therefore, the joint bar 13 is joined to the flange portions 39 and 27 by using the portion in which the outer stationary rail 11 is made to be shorter by the length LB. Initially, the joint bar 13 is received by the flange portion 27 of the outer mounting rail 7. Then, the joint bar 13 is pushed in the lengthwise direction, while the joint bar 13 is attracted toward the flange portion 39 of the outer stationary rail 11. Thus, the joint bar 13 can easily be joined to the two flange portions 39 and 27.

As described with reference to FIGS. 13 and 14, the sound absorbing member 4 is secured to the top portion 2 of the sound insulation wall 1 as indicated by reference numeral 4A shown in FIG. 15. Also an adjacent sound absorbing member 4B is, as indicated by an arrow C shown in FIGS. 13 and 14, mounted on the outer mounting rail 7 and the inner mounting rail 8. Then, the sound absorbing member 4B is pushed in a direction indicated by an arrow D so that the sound absorbing member 4B is secured to a predetermined position by the joint bar 13 and the bolt and nut 14.

Figure 15:
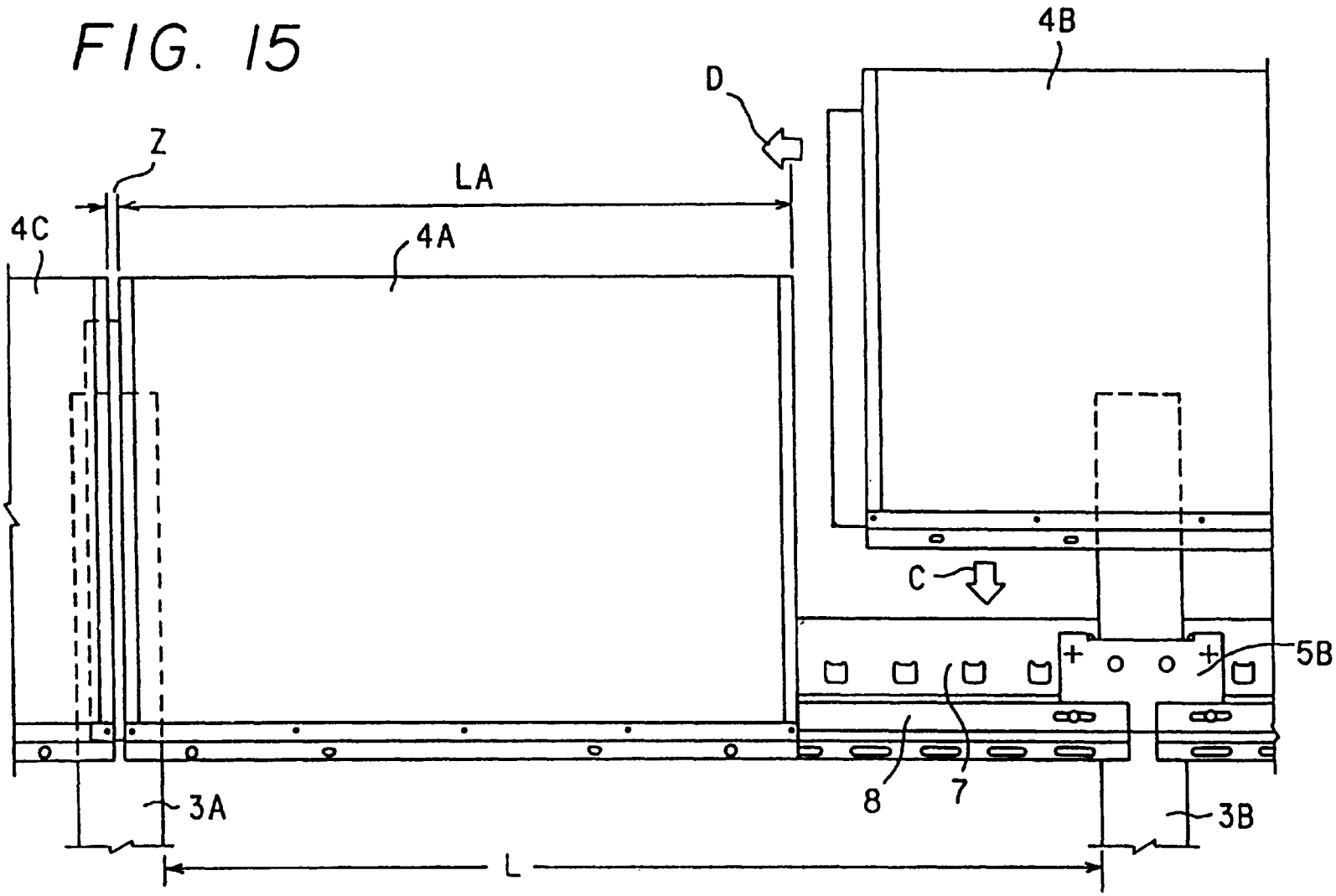
FIG. 15 is a front view showing an operation for mounting the sound absorbing member on the top portion of the sound insulation wall.

As shown in FIGS. 10 and 15, the length LA of each of the sound absorbing members 4, 4A and 4B is designed to be shorter than the distance L between the attachment base portions 3A and 3B. Moreover, the opened portion 48 is formed in the closing plate 45 of each of the sound absorbing members 4 and 4A as shown in FIG. 12. Therefore, the sound absorbing member 4B can be smoothly moved by pushing in the direction indicated by the arrow D in FIG. 15.

Figure 16:
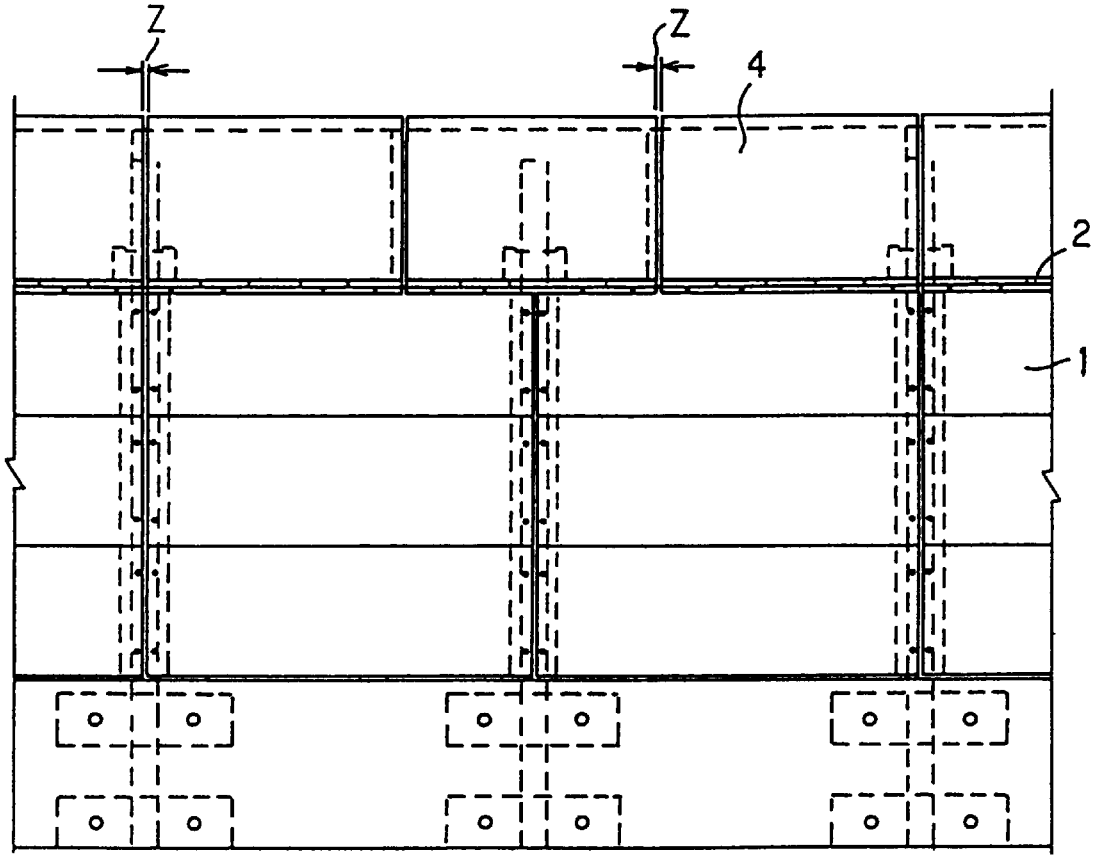
FIG. 16 is a front view of the sound insulation wall on which the sound absorbing member has been mounted.
Figure 17:
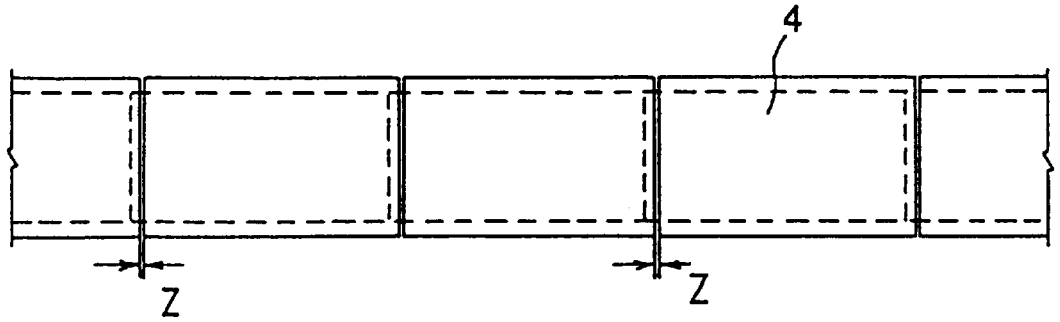
FIG. 17 is a front view showing the structure shown in FIG. 16.

FIGS. 16 and 17 show a state where the sound absorbing members 4 have been sequentially mounted on the top portion 2 of the sound insulation wall 1. Between adjacent sound absorbing members 4, for example, between the sound absorbing members 4A and 4C in the structure shown in FIG. 15, there are formed short-interval portions Z. As shown in FIG. 11, the short-interval portion Z is closed because the projecting closing plate 45 of one of the sound absorbing members 4 is received in the recessed closing plate 47 of the adjacent sound absorbing member 4. Note that design is made in such a manner that a space having a length somewhat longer than the length of the short-interval portion Z is formed between the front wall of the closing plate 45 and the back wall of the closing plate 47 after they are disposed at the designed positions.

The metal securing member 5 mounted and secured to the attachment base portion 3 has the insertion hole 15, as shown in FIGS. 1 and 2. The insertion hole 15 has the length WB larger than a predetermined width WA, to be adaptable to at least two standard dimensions of H-steel or the like serving as the column of the sound insulation wall 1.

When the member for forming the attachment base portion 3 is the H-steel which is the supporting column, and when plural types of the H-steel with standard dimensions comprise a flange having a constant width and webs having different lengths, the width WA of the insertion hole 15 is made to be adaptable to the width of the flange and the length WB of the insertion hole 15 is adapted to the longest length of the web. Thus, only one type of metal securing member 5 can be adapted to the attachment base portions 3 having a plurality of standard dimensions.

When one of the sound absorbing members 4 disposed sequentially as shown in FIGS. 16 and 17 is changed, the attachment by the bolt and nuts 4 between the sequentially disposed plural sound absorbing members 4 and the inner mounting rails 8 is released to shorten the short-interval portions Z, so that an interval between the sound absorbing member 4 to be changed and each of the adjacent sound absorbing members 4 is made longer than the length H of the closing plates 45 and 47 shown in FIG. 11. Thus, the sound absorbing member 4 can easily be changed. Since the outer mounting rail 7 and the sound absorbing member 4 are held by the joint bar 13 so as to be secured, the sound absorbing member 4 can easily be slid in the lengthwise direction thereof.

Although the above-mentioned embodiment has the structure that the attachment base portion, the metal securing member, the inner and outer mounting rails, the inner stationary rail and the like are screwed by bolts and nuts, the securing structure may be realized by any one of securing structures including welding, bonding, pressing by spring clips and fastening with bands.

As described above, according to the present invention, all of the operations for mounting the sound absorbing member to the top portion of the sound insulation wall can be completed from the sound source side of the sound insulation wall. Therefore, construction of scaffolding or use of a heavy machine, such as an overhang car, is not required in the portion opposite to the sound source side of an elevated expressway or the like. Moreover, safety of the operation can satisfactorily be secured. Therefore, effects can be obtained in that the efficiency of the operation can be improved and the construction time can be shortened.

The outer mounting rail arranged to be secured to a portion opposite to the sound source side has the upper end portion having the inverted L-shape and the lower end portion having the inverted and reversed F-shape. Moreover, the outer stationary rail to be secured to the outer mounting rail has the substantially arch-shaped cross section. Since the rails have many bent and arch-shaped portions, satisfactory rigidity can be obtained against external force which acts from a direction intersecting the lengthwise direction of the rail. Moreover, the top flanges of the two rails are held and secured by the joint bar of a sectional shape having substantially arched lips. Therefore, significantly strong rigidity can be obtained, thus causing an effect to be obtained in that the strength of the sound absorbing member mounted on the top portion of the sound insulation wall against side wind can significantly be enlarged.

The bent stepped portion of the lower portion of the outer stationary rail having the substantially arch-shaped cross section is received in the groove in the lower end portion of the outer mounting rail having the inverted and reversed F-shape. Moreover, both of the vertical wall portion of the received portion and the vertical wall portion following the two flange portions held and secured by the joint bar have the contact structures. Therefore, the sound absorbing member can accurately be located with respect to the outer mounting rail. As a result, an effect can be obtained in that the sound absorbing member can orderly be mounted only by a simple mounting operation.

Further, according to the present invention, both of the inner mounting rail and the inner stationary rail at the sound source side have the lower end portions having the inverted and reversed L-shapes. Moreover, the lower end portions are stacked and secured to each other. Therefore, an effect can be obtained in that the rigidity of the mounting structure can be enlarged. In addition, locating prior to performing the mounting operation can easily be performed.

Still further, according to the present invention, there is obtained an effect of facilitating mounting of the joint bar of a sectional shape having substantially arched lips on the flange portions of the outer mounting rail adjacent to the sound insulation wall and the outer stationary rail adjacent to the sound absorbing member.

Still further, according to the present invention, each sound absorbing member can be attached or removed without any interference with the attachment base portion. Moreover, releasing the attachment of each sound absorbing member and shortening the short-interval portion between sound absorbing members permit only one sound absorbing member to be removed. Therefore, an effect can be obtained in that change, repairing and maintenance operations can easily and smoothly be performed.

Still further, according to the present invention, the short-interval portion between adjacent sound absorbing members can be closed. Therefore, an effect can be obtained in that deterioration in the sound absorbing characteristic can be prevented.

Still further, according to the present invention, there is obtained an effect that the sound absorbing member can be mounted without any interference with the attachment base portion and the closing plate of the sound absorbing member.

Still further, according to the present invention, the single type metal securing member can be adapted to a variety of attachment base portions which have different standard dimensions. Thus, an effect can be obtained in that the number of elements and required labor can be reduced.

Still further, according to the present invention, the operation for mounting the sound absorbing member of the present invention can be performed safely. Moreover, the operation can be completed by performing simple operations including the mounting operation which is performed from an upper position, the securing operation and the operation for mounting the joint bar. Therefore, effects can be obtained in that the working efficiency can be improved, the construction time can be shortened and dangerous high elevation operations can be omitted.

Still further, according to the present invention, there is obtained an effect that the operations for holding and mounting rails and the stationary rails with the joint bar, which is performed inside the sound absorbing member at a side opposite to the sound source side, can safely and quickly be performed.

Still further, according to the present invention, the joined inner and outer mounting rails and stationary rails for a predetermined number of adjacent sound absorbing member are released and the short-interval portion between the sound absorbing members is shortened. Thus, spaces required to perform a removing operation can be created at the two ends of one sound absorbing member which must be removed. Therefore, an effect can be obtained in that the repairing operation including the operations for removing the sound absorbing member and mounting the same can easily and smoothly be performed.

What is claimed is:

1. A structure for mounting a sound absorbing member on a top portion of a sound insulation wall, comprising:

a metal securing member secured to each of attachment base portions which project upwards from the top portion of the sound insulation wall and are disposed at the same intervals;

an outer mounting rail having an upper end portion, a cross section of which is formed into an inverted L-shape and a lower end portion, a cross section of which is formed into an inverted and reversed F-shape, said outer mounting rail being secured to a side surface of said metal securing member opposite to a sound source side in such a manner that an inverted-F-shape opening portion of said outer mounting rail faces outside and said outer mounting rail is secured between adjacent metal securing members; and an outer stationary rail having a substantially arch-shaped cross section and secured to a portion of an inner wall of an inner cavity opened downwards and formed in a sound absorbing member which is disposed at a top portion of a sound insulation wall, said portion being opposite to said outer mounting rail, and a bent stepped central portion of said substantially arch-shaped outer stationary rail being secured to said portion, wherein a lower bent stepped portion of said outer stationary rail having the substantially arch-shaped cross section is received in a groove formed in the lower end portion, having the inverted and reversed F-shape cross section, of said outer mounting rail, vertical walls of said outer stationary rail and said outer mounting rail are brought into contact with each other, a flange portion of said outer stationary rail is positioned to form one plane with a flange portion of the top end portion, having the inverted L-shape, of said outer mounting rail, the vertical walls following said flange portions are brought into contact with each other, and said two flange portions are held and secured by a single joint bar of a sectional shape having substantially arched lips.

2. A structure for mounting a sound absorbing member on a top portion of a sound insulation wall according to claim 1, further comprising:

an inner mounting rail having a lower end portion, a cross section of which is formed into an inverted and reversed L-shape, said inner mounting rail being secured on the surface of said metal securing member at the sound source side between adjacent metal securing members in such a manner that a projecting and stepped portion having an inverted L-shape cross section of said inner mounting rail faces the sound source side; and an inner stationary rail having a lower end portion of an inverted and reversed L-shape, said inner stationary rail being secured to an end of an opening of the inner wall opposite to said inner mounting rail in the inner cavity opened in a lower surface of the sound absorbing member in such a manner that an inverted L-shape projecting and stepped portion of said inner stationary rail faces the sound source side, and an inner surface of said lower end portion of said inner stationary rail is brought into contact with an outer surface of said lower end portion of said inner mounting rail having the inverted and reversed L-shape cross section so as to be secured.

3. A structure for mounting a sound absorbing member on a top portion of a sound insulation wall according to claim 1, wherein a length of said outer stationary rail is shorter than a length of the sound absorbing member.

4. A structure for mounting a sound absorbing member on a top portion of a sound insulation wall according to claim 1, wherein a length of the sound absorbing member is shorter than a distance between adjacent attachment base portions, and a uniform short-interval portion is formed between adjacent sound absorbing members each secured to the top portion of the sound insulation wall.

5. A structure for mounting a sound absorbing member on a top portion of a sound insulation wall according to claim 1, wherein one end of the sound absorbing member is closed by a projecting closing plate and the other end is closed by a recessed closing plate.

6. A structure for mounting a sound absorbing member on a top portion of a sound insulation wall according to claim 5, wherein an opening for allowing said attachment base portion to pass through, is disposed in said projecting closing plate from a lower end portion toward an upper portion of said closing plate.

7. A structure for mounting a sound absorbing member on a top portion of a sound insulation wall according to claim 1, wherein a size of an insertion hole of said metal securing member fitted and secured to said attachment base portion is determined to be adaptable to a maximum outer size of a plurality of standardized attachment base portions.

8. A method of mounting a sound absorbing member on a top portion of a sound insulation wall, comprising the steps of:

preparing a number of sound absorbing members, each comprising:

(1) an outer stationary rail having a substantially arch-shaped cross section secured to a portion of an inner surface of an inner cavity opened downwards and formed in said sound absorbing member opposite to a sound source side in such a manner that said outer stationary rail is secured at a bent and stepped central portion of said arch-shaped outer stationary rail, and (2) an inner stationary rail having a lower end portion, a cross section of which is formed into an inverted and reversed L-shape, secured to an inner surface of said inner cavity placed at the sound source side in such a manner that an L-shape projecting and stepped portion of said inner stationary rail faces the sound source side;

determining a sound source side portion with respect to a sound insulation wall to be a working position;

securing a metal securing member to each of attachment base portions which project from a top portion of a sound insulation wall;

securing an outer mounting rail having an upper end portion, a cross section of which is formed into an inverted L-shape and a lower end portion, a cross section of which is formed into an inverted and reversed F-shape, to a side surface of said metal securing member opposite to a sound source side in such a manner that an inverted-F-shape opening portion of said lower end portion of said outer mounting rail faces outside, and said outer mounting rail is secured between adjacent metal securing members;

securing an inner mounting rail having a lower end portion, a cross section of which is formed into an inverted and reversed L-shape, to a surface of said metal securing member at the sound source side in such a manner that a projecting and stepped portion of an inverted L-shape cross section of said lower end of said inner mounting rail faces the sound source side, and said inner mounting rail is secured between the adjacent metal securing members; and inserting the sound absorbing member, from an upper position, to a place between adjacent attachment base portions to which said two mounting rails have been secured, in such a manner that said sound absorbing member is attracted to a portion opposite to the sound source side so that a vertical position of said sound absorbing member is fixed;

attracting the sound absorbing member toward the sound source side so that a lower bent stepped portion of a substantially arched-shape cross section of said outer stationary rail is received in a groove formed in a lower end portion of an inverted and reversed F-shape cross section of said outer mounting rail to fix a position with respect to the sound source side;

making vertical wall portions of said two rails to be brought into contact with each other;

arranging a flange portion of a top portion of said outer stationary rail and a flange portion of an upper portion of an inverted L-shape cross section of said outer mounting rail on the same plane;

making vertical walls following the flange portions to be brought into contact with each other;

mounting a single joint bar of a sectional shape with substantially arched lips, from a lengthwise direction, on the two flange portions disposed on the same plane so that the two flange portions are held and secured;

making an inner surface of the lower end portion of the inverted and reversed L-shape cross section of said inner stationary rail to be brought into contact with an outer surface of the inverted and reversed L-shape cross section of the lower end portion of said inner mounting rail; and securing said inner stationary rail and said inner mounting rail to each other.

9. A method of mounting a sound absorbing member on a top portion of a sound insulation wall according to claim 8, wherein a space between an inner wall of the inner cavity of said sound absorbing member at a lower surface and at a side opposite to the sound source side, and the flange portion of said outer mounting rail secured to said attachment base portion, said space being formed because a length of said outer stationary rail of said sound absorbing member is shorter than a length of said sound absorbing member, is used in such a manner that said joint bar is first mounted to the flange portion of said outer mounting rail, and then moved in the lengthwise direction to mount said joint bar on the flange portion of said outer stationary rail.

10. A method of mounting a sound absorbing member on a top portion of a sound insulation wall according to claim 8, wherein a uniform short-interval portion is formed between adjacent sound absorbing members disposed and secured to the top portion of the sound insulation wall so that said sound absorbing members are secured.

* * * * *